US007448959B2

(12) United States Patent
Blankenship et al.

(10) Patent No.: US 7,448,959 B2
(45) Date of Patent: Nov. 11, 2008

(54) GOLF CLUB HEAD WITH A DETACHABLE FACE PLATE AND METHOD OF TUNING THE GOLF CLUB HEAD

(75) Inventors: Jeffery A. Blankenship, Phoenix, AZ (US); David E. Wright, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 174 days.

(21) Appl. No.: 11/188,026

(22) Filed: Jul. 21, 2005
(Under 37 CFR 1.47)

(65) Prior Publication Data

US 2007/0021233 A1 Jan. 25, 2007

(51) Int. Cl.
*A63B 53/04* (2006.01)

(52) U.S. Cl. ..... 473/329; 473/333; 473/340; 473/342; 473/350

(58) Field of Classification Search ..... None
See application file for complete search history.

(56) References Cited

U.S. PATENT DOCUMENTS

| | | | | | |
|---|---|---|---|---|---|
| 5,467,983 | A * | 11/1995 | Chen | 473/342 |
| 5,482,282 | A * | 1/1996 | Willis | 473/342 |
| 5,720,673 | A * | 2/1998 | Anderson | 473/342 |
| 5,911,637 | A * | 6/1999 | Yamagata | 473/333 |
| 6,042,486 | A * | 3/2000 | Gallagher | 473/329 |
| 6,354,956 | B1 * | 3/2002 | Doong | 473/219 |
| 6,375,583 | B1 | 4/2002 | Solheim | |
| 6,417,450 | B1 * | 7/2002 | Young | 473/340 |
| 6,428,423 | B1 * | 8/2002 | Merko | 473/307 |
| 6,478,694 | B2 | 11/2002 | Anderson et al. | |
| 6,605,008 | B1 * | 8/2003 | Kovarik | 473/329 |
| 7,192,363 | B2 * | 3/2007 | Blankenship | 473/326 |
| 2002/0022532 | A1 * | 2/2002 | Tucker | 473/288 |
| 2006/0166754 | A1 * | 7/2006 | Kang | 473/242 |

* cited by examiner

*Primary Examiner*—Gene Kim
*Assistant Examiner*—Alvin A Hunter
(74) *Attorney, Agent, or Firm*—Darrell F. Marquette; John D. Titus

(57) ABSTRACT

A golf club head and a method of tuning the golf club head. The golf club head includes a body having a front surface, a back surface, a heel end, a toe end, a sole extending between the lower portions of the heel and the toe ends, a top portion extending between the upper portions of the heel and toe ends, and a cavity. One or more magnets are mounted in the cavity such that their distance into the cavity can be adjusted. A detachable face plate having one or more magnets attached to a back surface of the detachable face plate is slidably mated with guides extending from the body. At least two of the magnets are positioned such that the north pole of the magnet in the cavity faces the north pole of a magnet attached to the back surface of the detachable face plate. A repulsive force between the north poles pushes the detachable face plate away from the body and into a stop coupled to the body. The strength of the repulsive force is adjusted by the distance between the magnets to provide a golfer with the desired face plate stiffness.

19 Claims, 4 Drawing Sheets

GOLF CLUB HEAD WITH A DETACHABLE FACE PLATE AND METHOD OF TUNING THE GOLF CLUB HEAD

BACKGROUND OF THE INVENTION

The present invention relates generally to golf equipment and, in particular, to a golf club head.

An important factor governing the distance and accuracy of a golfer's drive is the amount of energy transferred from the golf club head to a golf ball when it impacts the golf ball. Ideally, the point of impact on the face of the golf club head is below the center of gravity of the golf club head and the point of impact on the golf ball is below the center of gravity of the golf ball. In addition, the theoretical plane containing the impact point on the golf club head, the center of gravity of the golf club head, and the center of gravity of the golf ball should be in alignment with the intended travel path of the golf ball. When these conditions are met, the golf club head is properly aligned and produces maximum face response characteristics.

To help golfers achieve proper alignment, golf club manufacturers have concentrated a relatively large mass of the golf club head in its sole. This configuration has made it easier for a golfer to place the center of gravity of the golf club head below the center of gravity of the golf ball; however it is still difficult for a golfer to achieve perfect alignment. For example, a golfer may have the club head square immediately prior to impact, but the actual point of impact with the club head may be shifted from the desired point on the club head to either the heel end or the toe end. This results in improper alignment because the club head becomes twisted to an out of square position and results in less than the maximum amount of energy being transferred to the golf ball. The terms twisting, twisted, or gyration are used here to define a rotation of the club head at the time of impact about an axis which passes through the center of gravity of the club head and is parallel to the axis of the golf club shaft. To dampen or reduce the effects caused by twisting of the club head, golf club manufacturers have placed relatively large concentrations of mass in the heel and toe of the club head to increase the moment of inertia and thereby maximize the energy transfer from the club head to the golf ball. Although these techniques have improved the ability of the golfer to increase the consistency with which they properly align the golf club, slight misalignment of the golf club head results in less than optimum face response characteristics.

In addition, an important criterion in selecting a golf club is the "feel" of the club when the club face contacts the golf ball. One of the factors contributing to the "feel" of the golf club is the stiffness of the club face. Because no two golfers are the same, the "feel" of the club preferred by one golfer might be different from that preferred by another golfer. However, golf club manufacturers have been constrained to manufacture sets of golf clubs with a fairly uniform stiffness. Thus, golfers have been limited in their choices of clubs with respect to the stiffness of the golf club.

Accordingly, what is needed is a golf club head, a method for manufacturing the golf club head, and a method for tuning the golf club head that permits adjusting the stiffness and the face response characteristics of the golf club head.

SUMMARY OF THE INVENTION

The present invention satisfies the foregoing need by providing a golf club head and a method of tuning the golf club head using a magnetic field. In accordance with one embodiment, the present invention includes a golf club head comprising a body wherein the body has a front body surface, a heel end, a toe end, a sole extending between lower portions of the heel and the toe ends, and a top portion extending between upper portions of the heel and toe ends. A face plate having first and second surfaces is coupled to the body.

In accordance with another embodiment, the present invention comprises a golf club head comprising a body having a cavity, a first body surface, a heel end, a toe end, a sole extending between lower portions of the heel and the toe ends, a top portion extending between upper portions of the heel and toe ends, and a detachable face plate coupled to the body, the detachable face plate having first and second surfaces.

In accordance with yet another embodiment, the present invention includes a method of tuning a golf club head having a body which has a cavity, a heel end, a toe end, a sole extending between lower portions of the heel and the toe ends, a top portion extending between upper portions of the heel and toe ends, a back surface extending between the heel end and the toe end, and a front surface extending between the heel end and the toe end. At least one magnet having first and second poles is provided in the cavity and at least one magnet having first and second poles is coupled to the detachable face plate. The face plate is coupled to the body. The distance between the one or more magnets in the cavity and the one or more magnets coupled to the detachable face plate is set to give the golf club head the desired face response characteristics.

DESCRIPTION OF THE INVENTION

Figure 1:
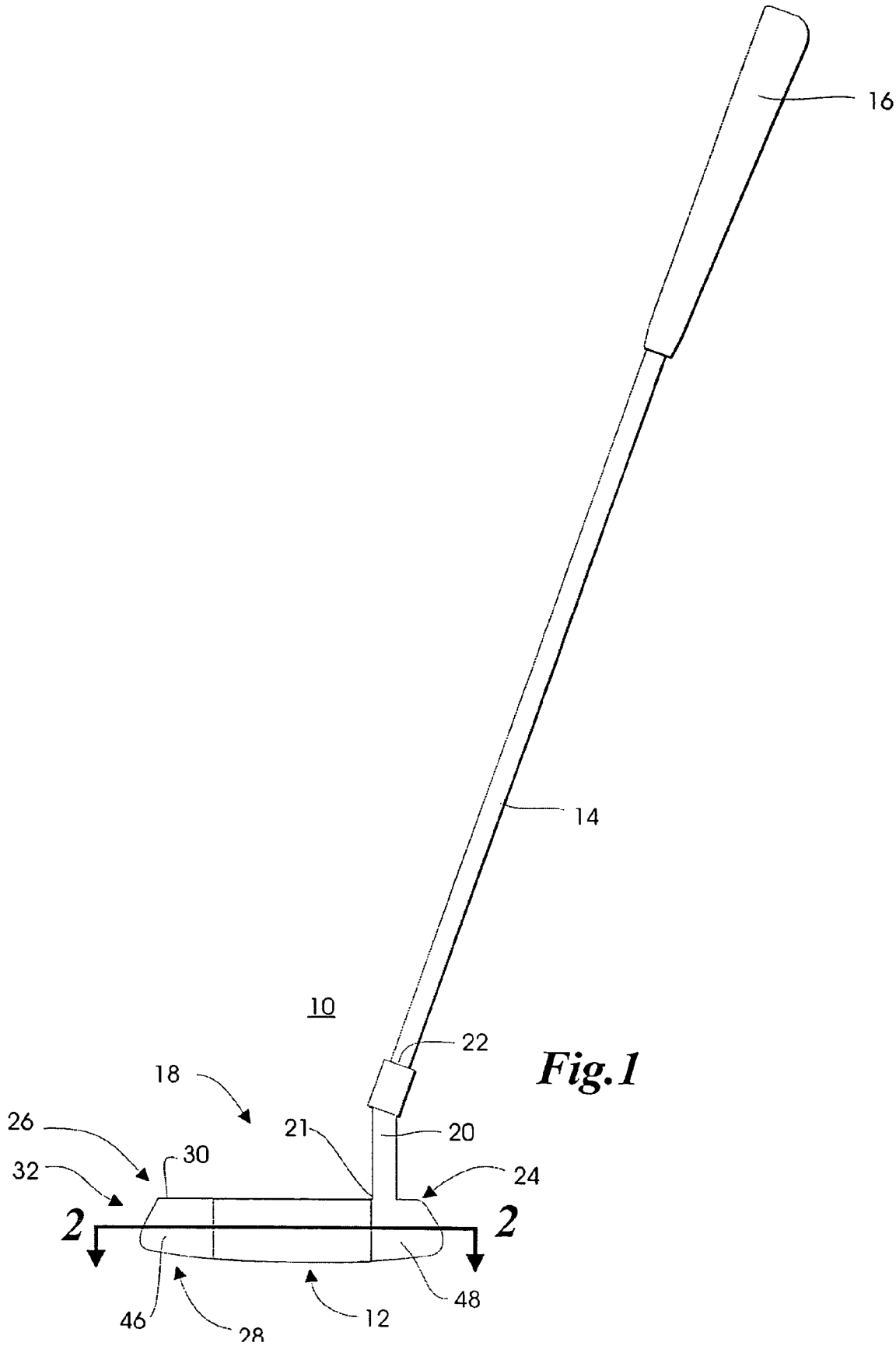
FIG. 1 illustrates a golf club including a putter head in accordance with an embodiment of the present invention.
Figure 2:
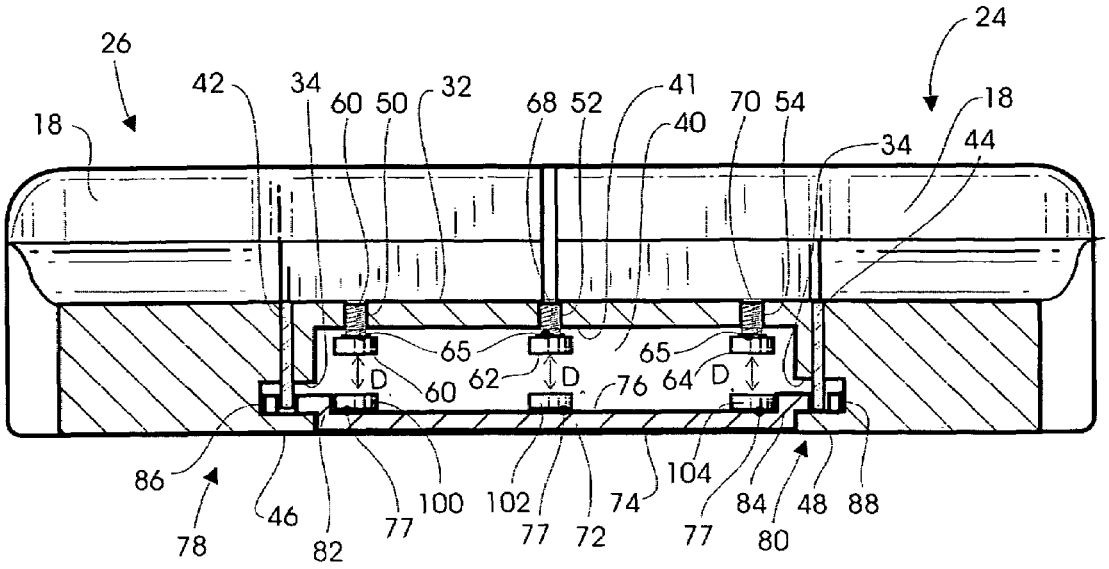
FIG. 2 illustrates a cross-sectional view of the putter head with a face plate taken along lines 2-2 in FIG. 1.

FIGS. 1 and 2 depict different views of a golf club in accordance with an embodiment of the present invention. For the sake of clarity, FIGS. 1 and 2 are described together. Briefly, FIG. 1 illustrates a golf club 10 including a club head such as a putter head 12 and a shaft 14. FIG. 2 illustrates a cross-sectional top view of putter head 12 taken along section line 2-2. Putter head 12 is connected to one end of the shaft 14 and a grip 16 is mounted on an opposing end of shaft 14. Suitable materials for shaft 14 include titanium, fiberglass, aluminum, steel, graphite, plastic, and wood, among others. Although golf club 10 is shown as having a putter head 12, it could have an iron-type head or a wood-type head.

Putter head 12 includes a body 18 and a hosel 20. The hosel 20 has a bore 22 for receiving one end of shaft 14 (shown in FIG. 1). Body 18 has a heel end 24 spaced apart from a toe end 26. A sole 28 extends from a lower portion of heel end 24 to a lower portion of toe end 26 and a top portion or rail 30 extends from an upper portion of heel end 24 to an upper portion of toe end 26. Body 18 has a back surface 32 that extends between heel end 24 and toe end 26 along a back or rear portion of body 18. Body 18 further includes a front surface 34 that extends between heel end 24 and toe end 26.

Hosel 20 includes a neck 21 connected to heel end 24 of body 18. Putter head 12 may be formed by casting, machining from solid castings, or the like. Suitable materials for putter head 12 include, but are not limited to, stainless steel, titanium, aluminum, nickel, alloys of titanium, alloys of aluminum, alloys of nickel, and the like.

A cavity 40 (shown in FIG. 2) having a cavity surface 41 extends from front surface 34 into body 18. Cavity 40 can be formed by techniques such as, for example, molding, machining, and the like. Guide members 42 and 44 extend from back surface 32 through front surface 34. By way of example, guides 42 and 44 are pins. An L-shaped stop 46 extends from toe end 26 of body 18 over pin 42 and an L-shaped stop 48 extends from heel end 24 of body 18 over pin 44. They prevent face plate 72 and body 18 from becoming uncoupled from each other. Although L-shaped stops 46 and 48 are shown as being spaced apart from guide pins 42 and 44, respectively, this is not a limitation of the present invention. L-shaped stops 46 and 48 may contact guide pins 42 and 44, respectively. Stops 46 and 48 are not limited to being L-shaped.

Threaded holes 50, 52, and 54 are formed in body 18 and extend from back surface 32 to cavity surface 41. In accordance with one embodiment, three holes 50, 52, and 54 are formed in body 18. However, the number of holes formed in body 18 is not a limitation of the present invention. There may be more than three holes or fewer than three holes. Magnets 60, 62, and 64 are connected to the ends of screws 66, 68, and 70, respectively, using an adhesive material 65 such as, for example, an epoxy adhesive. Alternatively, magnets 60, 62, and 64 are connected to respective screws 66, 68, and 70 using techniques such as soldering, braising, welding, frictionally fitting a portion of the screw into a hole in the magnet, or the like. Preferably, the same poles of each magnet 60, 62, and 64 are connected to screws 66, 68, and 70. For example, screws 66, 68, and 70 are connected to the magnetic south poles of magnets 60, 62, and 64, respectively. Thus, the magnetic north poles of magnets 60, 62, and 64 face away from cavity surface 41. Screws 66, 68, and 70 are screwed into respective holes 50, 52, and 54.

Figure 3:
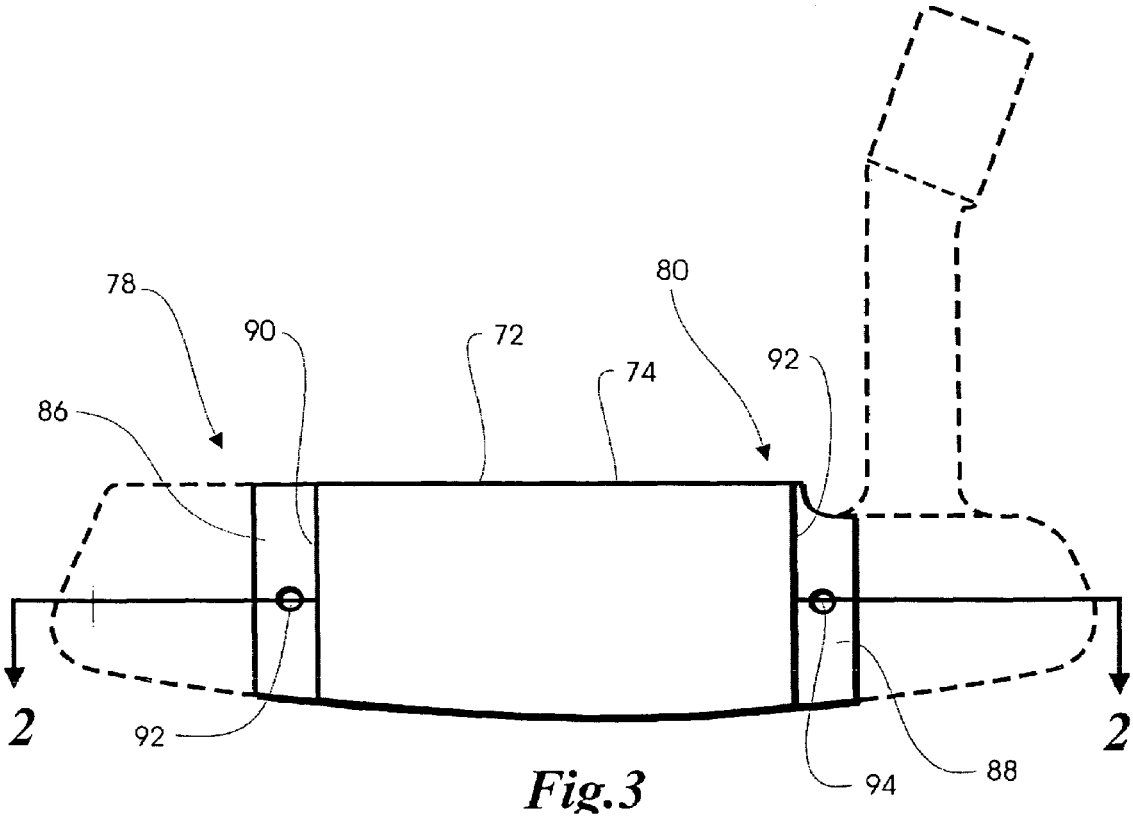
FIG. 3 is front view of the face plate shown in FIGS. 1 and 2.

Face plate 72 has a first or front surface 74, a second or back surface 76, and L-shaped ends 78 and 80, which are comprised of legs 82 and 84 and base portions 86 and 88, respectively. Briefly referring to FIG. 3, a front view of face plate 72 is illustrated. What is shown in FIG. 3 is front surface 74 and ends 78 and 80. Creases 90 and 92 indicate the locations of legs 82 and 84 of L-shaped ends 78 and 80, respectively. Base portions 86 and 88 have openings 92 and 94 through which guide pins 42 and 44 are inserted. Suitable materials for face plate 72 include non-ferrous-materials, wood, plastics, ceramics, and metals.

Referring again to FIG. 2, magnets 100, 102, and 104 are attached to back surface 76 of plate 72. In accordance with one embodiment, the magnetic south poles of magnets 100, 102, and 104 are attached to back surface 76 using an adhesive material 77 such as, for example, an epoxy adhesive. Thus, the magnetic north poles of magnets 100, 102, and 104 face toward cavity surface 41 and toward magnets 60, 62, and 64, and the north poles of magnets 60, 62, and 64 face the north poles of magnets 100, 102, and 104, respectively. Magnet 60 is spaced apart from magnet 100 by a distance $D_1$, magnet 62 is spaced apart from magnet 102 by a distance $D_2$, and magnet 64 is spaced apart from magnet 104 by a distance $D_3$.

Although the magnets have been shown and described as being oriented such that the north poles of magnets 60, 62, and 64 face the north poles of magnets 100, 102, and 104, respectively, this is not a limitation of the present invention. For example, the magnets may be oriented so that the south poles of magnets 60, 62, and 64 face the south poles of magnets 100, 102, and 104, respectively, i.e., magnets 60, 62, and 64 are oriented to repel magnets 100, 102, and 104, respectively. Alternatively, magnets 60 and 64 may be oriented so that their north poles face the north poles of magnets 100 and 104, respectively, while magnets 62 and 102 are oriented so that the north pole of magnet 62 faces the south pole of magnet 102. In other words, magnets 60 and 64 repel magnets 100 and 104, respectively, while magnets 62 and 102 attract each other. In yet another alternative, magnets 60 and 62 may be oriented so that their north poles face the north poles of magnets 100 and 102, respectively, while magnets 64 and 104 are oriented so that the north pole of magnet 64 faces the south pole of magnet 104. In other words, magnets 60 and 62 repel magnets 100 and 102, respectively, while magnets 64 and 104 attract each other. Alternating the polarity of the magnets allows for a broader range of responses. It should be understood that the combination of the magnetic orientations of the magnets is not a limitation of the present invention.

In operation, face plate 72 is positioned on body 18 such that guide pin 42 is inserted into opening 92 and guide pin 44 is inserted into opening 94. Guide pins 42 and 44 help hold face plate 72 in proper position. Because the north poles of magnets 60, 62, and 64 face the north poles of magnets 100, 102, and 104, the magnets repel each other and push face plate 72 against stops 46 and 48, thereby changing the dampening effect on the face of the putter head. The magnitudes of the repulsive forces are dependent on distances $D_1$, $D_2$, and $D_3$, which are adjusted by turning screws 66, 68, and 70. Thus, screws 66, 68, and 70 and holes 50, 52, and 54 cooperate to form a means for adjusting distances $D_1$, $D_2$, and $D_3$. Distances $D_1$, $D_2$, and $D_3$ are tuned to provide each individual golfer with his or her desired "feel." For example, a golfer may desire a putter head with a stiffer face than a typical putter head. Thus, the golfer can adjust screws 66, 68, and 70 to give putter head 12 the desired stiffness.

Figure 4:
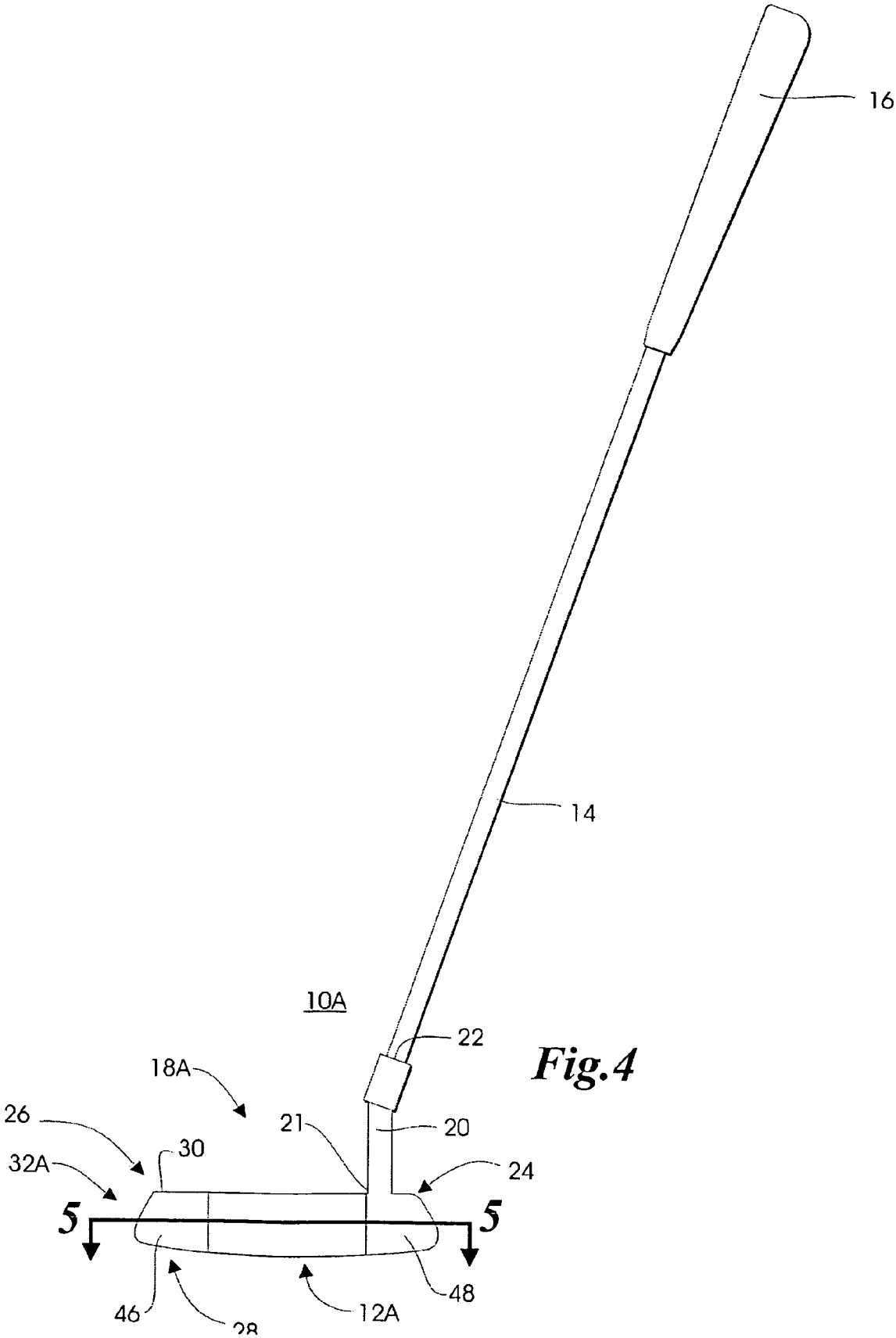
FIG. 4 illustrates a golf club including a putter head in accordance with another embodiment of the present invention.
Figure 5:
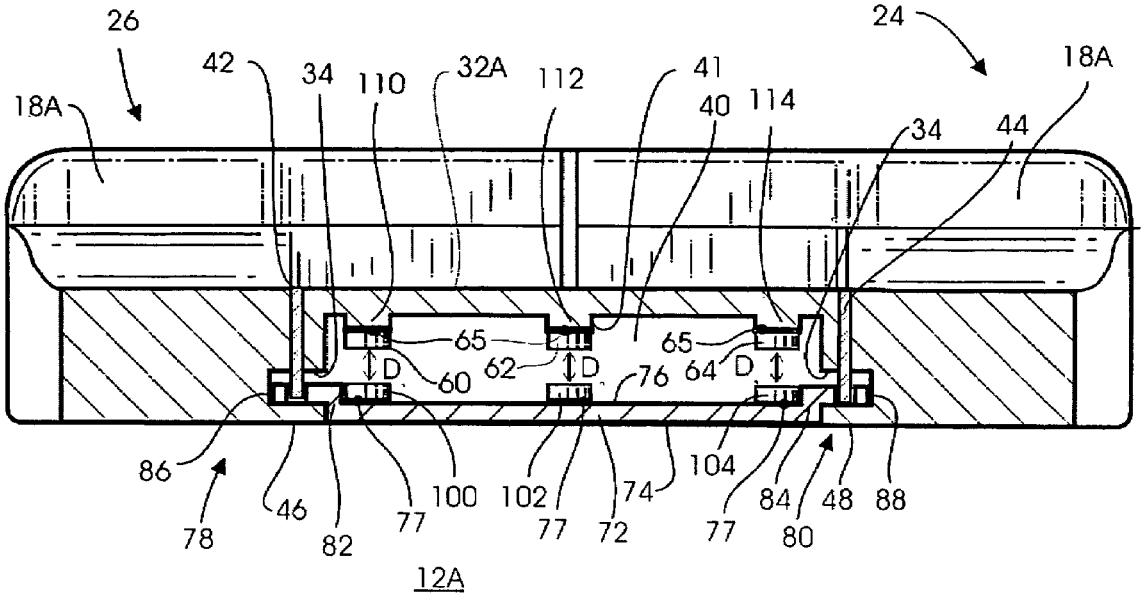
FIG. 5 is a cross-sectional view of the putter head taken along lines 4-4 in FIG. 4.

FIGS. 4 and 5 depict different views of a golf club in accordance with another embodiment of the present invention. For the sake of clarity, FIGS. 4 and 5 are described together. Briefly, FIG. 4 illustrates a golf club 10A including a putter head 12A and a shaft 14. FIG. 5 illustrates a cross-sectional top view of putter head 12A taken along section line 4-4. It should be noted that the difference between the embodiment shown in FIGS. 4 and 5 and the embodiment shown in FIGS. 1 and 2 is that body 18A of putter head 12A has pedestals 110, 112, and 114 for coupling to magnets 60, 62, and 64. Accordingly, common reference numbers between FIGS. 4 and 5 and FIGS. 1 and 2 have been preserved. Putter head 12A is connected to one end of a shaft 14 and a grip 16 is mounted on an opposing end of shaft 14. Although golf club 10A is shown as having a putter head, it could have an iron-type head or a wood-type head.

Putter head 12A includes a body 18A and a hosel 20, which has a bore 22 for receiving one end of shaft 14 (shown in FIG. 1). Body 18A has a heel end 24 spaced apart from a toe end 26. A sole 28 extends from a lower portion of heel end 24 to a lower portion of toe end 26 and a top portion or rail 30 extends from an upper portion of heel end 24 to an upper portion of toe end 26. Body 18A has a back surface 32A that extends between heel end 24 and toe end 26 along a back or rear portion of body 18A. Body 18A further includes a front surface 34 that extends between heel end 24 and toe end 26. Hosel 20 includes a neck 21 connected to heel end 24 of body 18. Putter head 12A may be formed by casting, machining from solid castings, or the like. Suitable materials for putter head 12A include, but are not limited to, stainless steel, titanium, aluminum, nickel, alloys of titanium, alloys of aluminum, alloys of nickel, and the like.

A cavity 40 (shown in FIG. 5) having a cavity surface 41 extends from front body surface 34 into body 18A. Cavity 40 can be formed by techniques such as, for example, molding, machining, and the like. Guides 42 and 44 extend from back surface 32A through front surface 34. By way of example, guides 42 and 44 are pins. An L-shaped stop 46 extends from body 18A over pin 42 and an L-shaped stop 48 extends from body 18A over pin 44. They prevent face plate 72 and body 18A from becoming uncoupled. Although L-shaped stops 46 and 48 are shown as being spaced apart from guide pins 42 and 44, respectively, this is not a limitation of the present invention. L-shaped stops 46 and 48 may contact guide pins 42 and 44, respectively. Stops 46 and 48 are not limited to being L-shaped.

Pedestals 110, 112, and 114 are formed in body 18 and extend from cavity surface 41 into cavity 40. In accordance with one embodiment, body 18A has three pedestals 110, 112, and 114. However, the number of pedestals formed from body 18A is not a limitation of the present invention. There may be more than three pedestals or fewer than three pedestals. Magnets 60, 62, and 64 are connected to the ends of pedestals 110, 112, and 114, respectively, using an adhesive material such as, for example, epoxy adhesive 65. Alternatively, magnets 60, 62, and 64 are connected to respective pedestals 110, 112, and 114 using techniques such as soldering, braising, welding, or the like. Preferably, the same poles of each magnet 60, 62, and 64 are connected to pedestals 110, 112, and 114. For example, pedestals 110, 112, and 114 are connected to the magnetic south poles of magnets 60, 62, and 64, respectively. Thus, the magnetic north poles of magnets 60, 62, and 64 face away from cavity surface 41.

Like the embodiment described with reference to FIGS. 1 and 2, the orientation of the magnetic poles of magnets 60, 62, 64, 100, 102, and 104 is not a limitation of the present invention. For example, the magnets may be oriented so that the south poles of magnets 60, 62, and 64 face the south poles of magnets 100, 102, and 104, respectively. Alternatively, magnets 60 and 64 may be oriented so that their north poles face the north poles of magnets 100 and 104, respectively, while magnets 62 and 102 are oriented so that the north pole of magnet 62 and faces the south pole of magnet 102, i.e., magnet 60 repels magnet 100, magnet 64 repels magnet 104, and magnet 62 attracts magnet 102. In yet another alternative, magnets 62 and 64 may be oriented so that their north poles face the north poles of magnets 102 and 104, respectively, while magnets 60 and 100 are oriented so that the north pole of magnet 60 faces the south pole of magnet 100. In other words, magnets 62 and 64 repel magnets 102 and 104, respectively, while magnets 60 and 100 attract each other. Alternating the polarity of the magnets allows for a broader range of responses. An advantage of the embodiment described with reference to FIGS. 4 and 5 is that the distance between magnets 60, 62, and 64 and magnets 100, 102, and 104, respectively, can be set at the factory thereby facilitating the production of large quantities of golf clubs having a predetermined stiffness. This allows a golfer to select a golf club with a desired stiffness without a subsequent adjustment.

What is claimed is:

1. A golf club head comprising:

a body having a front portion, a heel end, a toe end, a sole extending between lower portions of the heel and the toe ends, a top portion extending between upper portions of the heel and the toe ends;

a floating face plate slidably coupled to the body adjacent the front portion thereof and moveable in a forward and rearward direction relative to the body, the face plate having a front surface and a back surface;

a stop member for retaining the face plate to the body;

a first magnet on the back surface of the face plate;

a second magnet on the body; and the first and second magnets being arranged so that they oppose each other thereby forcing the face plate in said forward direction.

2. A golf club head comprising:

a body having a front portion, a heel end, a toe end, a sole extending between lower portions of the heel and the toe ends, a top portion extending between upper portions of the heel and the toe ends;

a floating face plate slidably coupled to the body adjacent the front portion thereof and moveable in a forward and rearward direction relative to the body, the face plate having a front surface and a back surface;

a stop member for retaining the face plate to the body;

a first plurality of magnets connected to the back surface of the face plate;

a second plurality of magnets on the body; and the first and second pluralities of magnets being arranged so that each magnet of the first plurality of magnets opposes a corresponding magnet of the second plurality of magnets thereby forcing the face plate in said forward direction.

3. The golf club head of claim 2, further comprising:

a guide member extending from the body into the face plate to properly orient the face plate with respect to the body; and a stop member on the body for preventing the face plate from being uncoupled from the body.

4. The golf club head of claim 3, further comprising means for adjusting distance between respective magnets of the first and second pluralities of magnets with each magnet of the second plurality of magnets connected to the means for adjusting distance.

5. The golf club head of claim 4, wherein the means for adjusting distance comprises a plurality of screws received in threaded holes formed in the body.

6. The golf club head of claim 3, wherein the face plate has an opening extending from the back surface into the face plate for receiving the guide member.

7. A golf club head comprising:

a body having a front portion, a heel end, a toe end, a sole extending between lower portions of the heel and the toe ends, a top portion extending between upper portions of the heel and the toe ends;

a floating face plate slidably coupled to the body adjacent the front portion thereof and moveable in a forward and rearward direction relative to the body, the face plate having a front surface and a back surface;

a stop member for retaining the face plate to the body; and the face plate is being slidably coupled to the body by means of an opening that extends through the face plate and receives a guide pin that extends from the body.

8. A golf club head comprising:

a body having a front portion, a heel end, a toe end, a sole extending between lower portions of the heel and the toe ends, a top portion extending between upper portions of the heel and the toe ends;

a floating face plate slidably coupled to the body adjacent the front portion thereof and moveable in a forward and rearward direction relative to the body, the face plate having a front surface and a back surface;

a stop member for retaining the face plate to the body; and the face plate being slidably coupled to the body by means of a plurality of openings that extend through the face plate, each receiving a guide pin that extends from the body.

9. A golf club head comprising:

a body having a front portion, a heel end, a toe end, a sole extending between lower portions of the heel and toe ends, a top portion extending between upper portions of the heel and the toe ends;

a floating face plate slidably coupled to the body adjacent the front portion thereof and moveable in a forward and rearward direction relative to the body, the floating face plate having front and back surfaces;

a stop member for retaining the face plate to the body; and a first plurality of magnets connected to the back surface of the floating face plate.

10. The golf club head of claim 9, further comprising:

a second plurality of magnets on the body; means for adjusting distance between respective magnets of the first and second pluralities of magnets; and each magnet of the second plurality of magnets being connected to the means for adjusting distance.

11. The golf club head of claim 10, wherein the means for adjusting distance comprises a screw received in a threaded hole formed in the body.

12. The golf club head of claim 9, further comprising:

a guide member extending from the body;

the floating face plate having an opening; and the guide member cooperating with the opening in the floating face plate to guide the face plate with respect to the body.

13. The golf club head of claim 12, wherein the first plurality of magnets comprises three magnets and the second plurality of magnets comprises three magnets, and wherein a first magnet of the first plurality of magnets is aligned with and repulsed by a first magnet of the second plurality of magnets;

a second magnet of the first plurality of magnets is aligned with and repulsed by a second magnet of the second plurality of magnets; and a third magnet of the first plurality of magnets is aligned with and repulsed by a third magnet of the second plurality of magnets.

14. The golf club head of claim 12, further including a pedestal extending from the body into the cavity and being aligned with one magnet of the first plurality of magnets.

15. The golf club head of claim 14, further comprising:

the body having a cavity formed therein;

a plurality of pedestals on the body extending into the cavity; and a second plurality of magnets, wherein each magnet of the second plurality of magnets is connected to a corresponding pedestal of the plurality of pedestals.

16. A method of tuning a golf club head, comprising:

providing a body having a cavity, a heel end, a toe end, a sole extending between lower portions of the heel and the toe ends, a top portion extending between upper portions of the heel and the toe ends, a back surface extending between the heel end and the toe end, a front surface extending between the heel end and the toe end;

providing a first magnet in the cavity, the first magnet having first and second poles;

providing a floating face plate having a front surface and a back surface, wherein a second magnet having first and second poles is connected to the floating face plate;

slidably coupling the floating face plate to the body so that the face plate is moveable in a forward and rearward direction relative to the body; and setting a distance between the first magnet in the cavity and the second magnet connected to the floating face plate.

17. The method of claim 16, wherein providing the first magnet in the cavity comprises:

providing means for setting distance between the first and second magnets; and connecting the first pole of the first magnet in the cavity to the means for setting distance.

18. The method of claim 17, wherein the first pole of the second magnet is connected to the floating face plate.

19. The method of claim 17, further including forming a stop member in the body, wherein setting the distance between the first magnet in the cavity and the second magnet connected to the floating face plate includes magnetically repelling the floating face plate away from the front surface until the floating face plate contacts the stop member.

* * * * *

UNITED STATES PATENT AND TRADEMARK OFFICE

CERTIFICATE OF CORRECTION

PATENT NO. : 7,448,959 B2
APPLICATION NO. : 11/188026
DATED : November 11, 2008
INVENTOR(S) : Blankenship et al.

It is certified that error appears in the above-identified patent and that said Letters Patent is hereby corrected as shown below:

Page 1, Col. 2, U.S. Patent Documents, Line 3 delete "6,417,450 7/2002 Young 473/304" and insert -- 6,517,450 02/2003 Klyve 473/340 --

Col. 6, Line 54 (Claim 7) delete "plate is being" and insert -- plate being --, therefor.

Signed and Sealed this

Eighth Day of September, 2009

David J. Kappos

David J. Kappos
*Director of the United States Patent and Trademark Office*